United States Patent [19]

Brown

[11] 4,186,894

[45] Feb. 5, 1980

[54] VEHICLE AND PROCESS FOR RETRIEVING FLEXIBLE PIPE

[75] Inventor: Thomas Brown, Casper, Wyo.

[73] Assignee: Chinook Utility Products, Inc., Douglas, Wyo.

[21] Appl. No.: 898,934

[22] Filed: Apr. 24, 1978

[51] Int. Cl.[2] ..... B65H 75/40

[52] U.S. Cl. ..... 242/86.6; 254/134.3 R

[58] Field of Search ..... 242/86.5 R, 86.2, 86, 242/86.52, 86.6, 86.7, 86.61; 254/134.3 R, 166, 190

[56] References Cited

U.S. PATENT DOCUMENTS

| | | | |
|---|---|---|---|
| 3,070,324 | 12/1962 | Bryman | 254/134.3 R X |
| 3,531,059 | 9/1970 | Walker | 242/86.5 R X |
| 3,995,355 | 12/1976 | Sneed | 242/86.6 |
| 4,071,203 | 1/1978 | Sneed | 242/86.6 |

*Primary Examiner*—Edward J. McCarthy
*Attorney, Agent, or Firm*—Trask & Britt

[57] ABSTRACT

A vehicle and process for retrieving flexible plastic pipe from on-the-ground field positions is disclosed. Flexible plastic pipe is finding increasing use in oil field installations for carrying fuel and water to field rigs. Flexible plastic pipe is laid onto the ground from a large reel on a mobile unit. Retrieval of the pipe in the instant invention is obtained by driving a truck having a large reel behind the cab and a pickup tube above the cab towards the pipe after attaching the pipe to the reel and threading it through the pickup tube. The forward end of the pickup tube is substantially above the ground so that it is within easy vision of the driver. The end of the tube can be flared so that pipe can be picked up from either side of the vehicle or from directly in front of the vehicle. Also, a sweep means is provided forward of the reel to lay the pipe onto the reel in proper fashion.

14 Claims, 11 Drawing Figures

VEHICLE AND PROCESS FOR RETRIEVING FLEXIBLE PIPE

BACKGROUND OF THE INVENTION

1. Field:

The invention relates to flexible pipe retrieving vehicles and to processes for retrieving flexible plastic pipe from above-ground installations, especially in oil and gas field use.

2. Prior Art:

Flexible pipe in an oil or gas field installation is presently recovered in several ways. One method is to use a truck having a large reel mounted thereon which has one end of the pipe attached to the reel. The truck is driven towards the pipe while a man on the truck guides the pipe onto the reel so that it will lay properly on the reel. This, of course, has certain disadvantages inasmuch as there is a person on the truck while it is being driven over frequently rough terrain. The individual could lose his balance and be injured. Also, this method requires both a driver for the truck and a person on the truck to guide the pipe. Also, as the pipe is being retrieved it is difficult work in handling the pipe so that the operation is limited to the strength and stamina of the individual on the truck.

Another technique used for recovering flexible pipe is that illustrated in U.S. Pat. No. 3,995,355 to Sneed et al. The Sneed technique is one wherein the pipe is recovered by cutting the pipe into short segments. Each segment is attached to the reel. The reel is rotated to drag the pipe onto the reel while the truck is stationary. The truck then proceeds to the next segment whereby the segments are fused together and the pipe is then reeled onto the reel with the truck being stationary. This method has disadvantages inasmuch as someone must first go over the string of pipe, which frequently may be one to several miles in length and cut the pipe into short segments. The pipe is then drug over the ground and is thus abraded and worn.

Other patents which have some pertinence to the instant invention are the patents to Walker, U.S. Pat. No. 3,531,059, which describes a vehicle for recovering fire hose. Walker discloses a pickup tube over the front of the truck wherein the tube terminates there at a level below the hood level.

U.S. Pat. No. 3,070,324 to Bryman relates to a portable wire reeling device. The device comprises a jeep or other small vehicle for reeling and unreeling transmission cable, that is, communication cable. A stall standard is placed in front of the vehicle with an eyelet for the cable to pass through. The cable may be recovered by driving the vehicle into the line to recover it. Recovery of cable is an easier task than recovering of flexible pipe which is generally two or more inches in diameter. Also, cable is more durable and there is less damage caused by dragging the cable over rough terrain and less harm to the cable if the vehicle runs over it.

Flexible pipe can be permanently damaged during recovery in the event the vehicle runs over the pipe in rough terrain. Oftentimes the damage would not be discovered until after the pipe had been used a second time and a number of leaks discovered in the pipe string. Thus, a recovery method for flexible pipe must treat the pipe as gently as possible considering the difficulty of the terrain and the difficulty of discovering and repairing leaks. This is particularly true since flexible pipe often carries natural gas to the drilling sight for use in driving motors. Not only could a substantial amount of gas be lost but a potential fire and/or explosion hazard could exist.

OBJECTS OF THE INVENTION

It is an object of the instant invention to provide a vehicle with efficient means of recovering flexible plastic pipe from a ground surface location.

Another object of the instant invention is to provide a vehicle retrieving means requiring a minimum of manual labor.

A further object of the instant invention is to provide a vehicle for recovering flexible plastic pipe with minimum damage to said pipe.

Another object of the instant invention is to provide a process for recovering flexible plastic pipe by a mobile vehicle whereby the pipe can be recovered from either side of the vehicle or directly in front of the vehicle.

DESCRIPTION OF INVENTION

The instant invention relates to a flexible pipe-carrying vehicle for laying and retrieving flexible pipe wherein a large reel is mounted on a self-propelled vehicle having a forward driving compartment. The reel is carried on the rear bed of the vehicle. A pickup tube having a front and rear opening is disposed along the longitudinal axis of the vehicle and located above the cab of the vehicle. The pickup tube has a forward opening which is well forward of the cab of the truck and located at a height which is easily visible to the driver of the truck.

The invention further relates to a process of retrieving a long string of flexible pipe from an above ground position. That is, the pipe is strung along the surface of the ground. The pipe is retrieved by threading a free end of the pipe through a pickup zone located above the mobile vehicle and then attaching the free end to a motor driven reel on the vehicle. While the reel is being rotated, the vehicle is driven forward toward the string of pipe to retrieve the pipe onto the reel.

The vehicle illustrated and described herein and the process disclosed are particularly advantageous inasmuch as a pipe is laid over all types of terrain and generally along either side of a rough access road towards the pipe.

In present gas drilling operations, a supply of water and fuel is required at the site. Many of these drilling sites are frequently in remote and rugged locations. The access road into the drilling rig is frequently very, very rough.

The flexible pipe is laid by taking a vehicle with a reel full of pipe to the drilling rig. One end of the pipe is attached to the terminal at the rig and then the vehicle is driven either across the open countryside or access road generally laying the pipe either directly behind the vehicle if it is an off-the-road installation or along one side or the other of the road wherein an access road is provided. Occasionally the pipe must be cut when being placed under a culvert or similar means in crossing another road or where it is desired to switch the installation from one side of a road to the other.

Techniques are known for fusing plastic pipe in the field. Oftentimes the pipe is cut, passed through a culvert and fused because of difficult terrain along one side of the road or merely to traverse a road. It is for this reason that it is very desirable to have a vehicle with a pickup means which can retrieve the pipe from either side of an access road. Also, it is very desirable to have the pickup means located so that the pipe can be easily seen by the driver of the truck, preferably so that the driver can see the pipe sufficiently far in front of the vehicle that he sees the pipe leaving the ground. If the driver of the vehicle can see the pipe leaving the ground then he can be certain that the pipe is not caught on a root or rock or similar obstruction.

Figure 1:
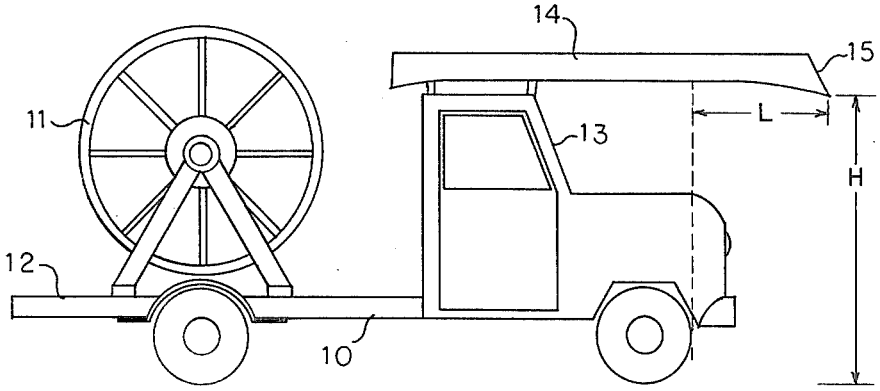
FIG. 1 is an elevational side view of a flexible pipe laying and recovering vehicle.

Further description of the invention may be faciliated by reference to the attached drawings. FIG. 1 is an elevational view of a self-propelled vehicle 10 having a large reel 11 located on the rear bed of the truck 12. A driver cab 13 is located on the lower portion of the vehicle. An elongated pickup tube 14 is attached to the vehicle above the driver's cab and extends well forward of the driver's cab. The forward end of the pickup tube 15 is located at a height (H) well above the ground and generally from about four feet to eight feet about the ground. The forward opening 15 is located a distance (L) forward of a vertical plane tangent to the front surface of the front wheel of the vehicle. The distance (L) is generally from about two to four feet.

The distances "H" and "L" may vary depending upon the size of the truck and location of the cab. However, the position of the forward opening of the tube should be such that the pipe, as it is being retrieved and passes through the forward opening, will leave the ground a sufficient distance in front of the vehicle that the driver will be able to see the pipe as it leaves the ground to be certain that it is not obstructed.

Figure 2:
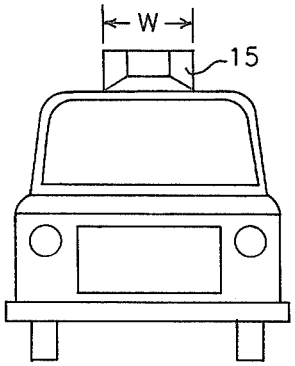
FIG. 2 is a front elevational view of the vehicle of FIG. 1.

Since the pipe being retrieved frequently will be along either side of an access road it is desirable that the forward opening of the pickup tube 14 be capable of retrieving the pipe easily up to an angle up to about 90° from the longitudinal axis of the truck. A retrieval angle of 60° is usually sufficient and is generally not exceeded. As illustrated in FIG. 2, the forward end of the pickup tube 14 has a flared opening 15 which has a width (W) of about two feet to about four feet. The forward portion of the tube should not be so low as to obstruct the view of the driver of the vehicle.

Figure 3:
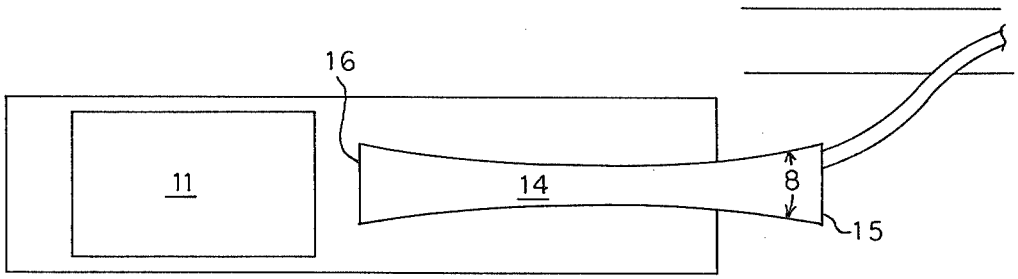
FIG. 3 is a plan view of the vehicle of FIG. 1.

The vehicle is further illustrated in FIG. 3 which has a top plan view of the vehicle and shows the forward opening 15 of the tube 14 being flared at an angle alpha which is an angle which may be up to about 90° to permit easy retrieval of the pipe from a ditch or other position on either side of an access road or from directly in front of the vehicle. The pickup tube 14 has a length sufficient so that the rear opening 16 is sufficiently close to the reel 11 so that the pipe may be easily directed onto the reel as it is being rotated. The rear opening 16 is illustrated as being a flared opening. This is a preferred embodiment although it should be understood that the rear opening need not be flared if the opening is not quite as close to the reel 11. Also, the pickup tube 14 is illustrated as being pinched or reduced in size near midsection. It should also be understood that the pickup tube may be the same width as its whole length. Thus, neither opening 15 nor 16 need be flared. However, unless rollers on a wide opening are utilized, it is generally preferred that the forward opening be flared so that the pipe will not be drug across an edge of the opening but will be contacting a relatively smooth surface.

Figure 4:
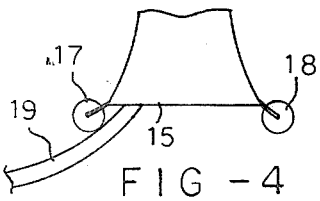
FIG. 4 is a fragmented view of the forward portion of a flexible pipe recovery tube in plan view.

Another embodiment of the forward opening of the flared tube is illustrated in FIG. 4 wherein rollers 17 and 18 are disposed vertically on either side of the opening 15. The rollers contact the pipe as it comes in to eliminate any friction which might be caused when the pipe is coming in at a sharp angle as illustrated by the pipe 19 coming into the tube. The angle of the pipe may be almost perpendicular to the longitudinal axis of the truck when the vehicle is picking up the pipe from the left side inasmuch as the driver being generally on the left side of the vehicle can see the pipe even though he is driving at a speed which would cause the pipe to be retrieved at a substantially wide angle to the longitudinal axis of the vehicle.

Figure 5:
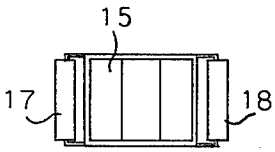
FIG. 5 is a front elevational view of the tube of FIG. 4.

Another view of the embodiment of FIG. 4 is illustrated in FIG. 5 which is a front elevational view showing rollers 17 and 18 along either each vertical edge of the flared opening 15.

Figure 6:
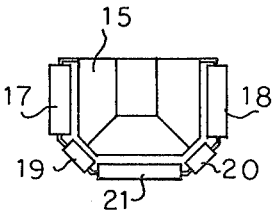
FIG. 6 is a front elevational view of a flexible pipe recovery tube having peripheral roller means.
Figure 7:
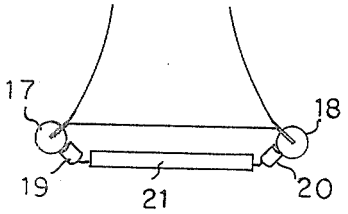
FIG. 7 is a plan view of the pickup tube illustrated in FIG. 6.

Another structure is illustrated in FIGS. 6 and 7 which provides rollers 19 and 20 at a slight angle to the vertical rollers 17 and 18 so in conjunction with roller 21 sides and bottom portion of the flared opening 15 is substantially encircled by rollers.

Figure 8:
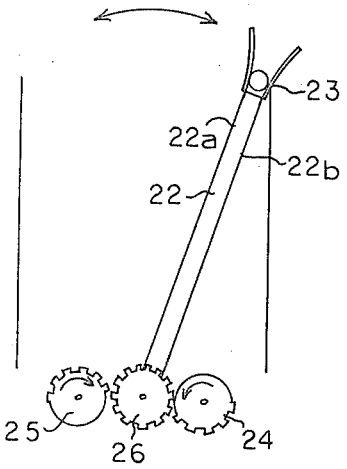
FIG. 8 is a front elevational view of a sweep arm for laying the pipe in proper position onto a rotating reel.

The mechanism for laying the pipe onto the reel as it is being rotated is illustrated in FIG. 8. A mechanism comprises an elongated sweep arm which is rotated over a short arc to move the pipe from one side of the reel to the other as it is being retrieved. A support bar 23 is located high along the arm 22. The support bar 23 supports the pipe as it passes between the side members **22*a* and 22*b* of the arm 22. The arm 22 is driven in reciprocating fashion by gears 24 and 25. Each gear has teeth over only one-half its circumference. Thus, when gear 24 has rotated in a counterclockwise position with its teeth in contact with the teeth of gear 26 to move the arm to an extreme position to the right (as illustrated in FIG. 8) at point, the teeth of gear 24 cease to engage teeth of gear 26 as the teeth of gear 25 begins to engage same. Gear 25 then rotates in a clockwise manner to rotate the swing arm 22** to counterclockwise to a position to the extreme left.

Figure 9:
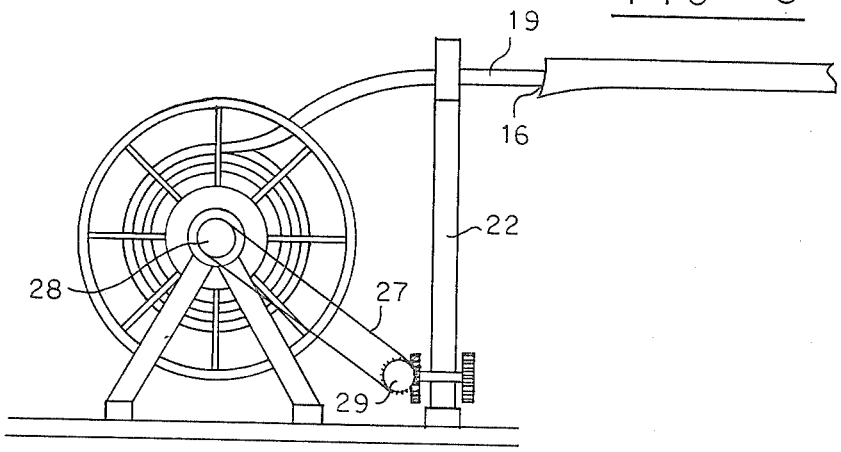
FIG. 9 is a side elevational view of the sweep arm of FIG. 8.

An elevational side view of the sweep arm 22 is illustrated in FIG. 9. The rear opening 16 is illustrated showing the pipe 19 feeding over the support bar 23 (not illustrated) to be directed upon the reel turning in a counter-clockwise position. The speed of swing of arm 22 is related to the rotational speed of the reel by chain 27 which connects gear 28 attached to the reel axle to gear 29 which is attached to an axle which indirectly drives the gears which rotate arm 22. The gear mechanism is illustrated in FIG. 11.

Figure 10:
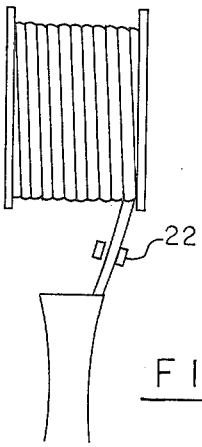
FIG. 10 is a plan view of the sweep arm illustrated in FIG. 8.

A top plan view of the swing arm is illustrated in FIG. 10 wherein arm 22 is shown guiding the pipe onto the right side of the reel as it rotates. Without the guide mechanism 22 the pipe would have to be fed by hand onto the reel 10 as it rotates or permit the pipe to lay down in random fashion which would not take advantage of the whole capacity of the reel.

Figure 11:
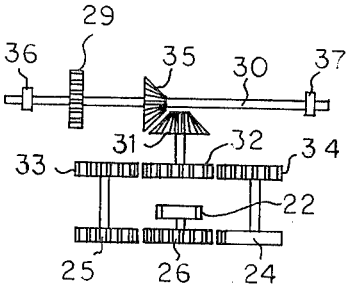
FIG. 11 is a plan view of the drive mechanism for driving the sweep arm.

In FIG. 11, which is a plan view, the gear mechanism is illustrated for driving the swing arm 22. Gear 29 is attached to a screw gear 30 which is supported on each end by trunnions 36 and 37. The shaft 30 turns a pinon gear 35 which meshes with a pinon gear 31 which is attached to a spur gear 32 which drives spur gears 33 and 34 in opposite directions. These drive gears 25 and 24, respectively, in turn, drive gear 26 with its reciprocating action to give a reciprocating motion to the arm 22.

The pickup tube has been illustrated herein in its preferred embodiment as a solid walled, enclosed tube. However, the tube may be an open trough although the forward end is preferably enclosed so that the pipe will not be bounced out of the trough at the forward end. Also, the tube may be an open cage-type framework since it is not essential that a solid walled retrieval tube be used. The purpose of the retrieval tube is to guide the pipe from its forward end to its rear end and onto the reel. It is generally preferred that the pipe be held in position in the tube.

The reel may be mounted upon a skid with supporting framework with linkage to a power take-off to drive the reel. The skid may be removed, e.g., when the reel is empty so that another skid with a full reel can be mounted thereon. Also, during retrieval, when a reel is full, the skid and reel may be removed and a skid with an empty reel mounted on the truck so retrieval of pipe can continue.

In retrieval of the pipe it is generally cut only at those joints where it was cut during placement, e.g., at culverts, or when a reel is filled.

The retrieval tube has been illustrated as being flat in a horizontal plane. It may, of course, be arched upwardly at the center to conform the shape of the tube to the arc of the pipe as it is being retrieved.

The advantages of the instant invention and the method which is involved in retrieving the pipe are significant. The pipe may be retrieved by a single operator with minimum risks to damage of the pipe. The pipe need not be drug over the rough or abrasive surface inasmuch as the truck drives right along or into the pipe as it is being retrieved. The driver of the truck can see the pipe losing contact with the ground and can be certain there are no obstructions to prevent clear recovery of the pipe.

I claim:

1. A pipe-laying vehicle for laying and retrieving flexible plastic pipe comprising:

a self-propelled vehicle having a forward driving compartment;

rear support means for supporting a large reel onto which flexible plastic pipe is carried;

a pickup tube having its rearward opening directed towards said reel and an elevated forward opening visible from the driving compartment, said forward opening having receiving means to receive flexible plastic pipe from directions of up to about 90° to either side of the longitudinal axis of the vehicle at forward openings.

2. The pipe-laying vehicle of claim 1 wherein said receiving means of said pickup tube comprises a laterally flared end wherein said end has a flare of up to about 90°.

3. The pipe-laying vehicle of claim 1 wherein said receiving means comprises a laterally flared end having an opening width of about one to about four feet.

4. The pipe-laying vehicle of claim 1 wherein the rearward opening of said pickup tube is at least as high as the top of said reel.

5. The pipe-laying vehicle of claim 4 wherein the rearward opening of said pickup tube is laterally flared.

6. The pipe-laying vehicle of claim 1 having vertical sweep means for directing the pipe onto said reel.

7. The pipe-laying vehicle of claim 6 wherein said sweep means has a pipe-carrying bar located at about the same level as the top of said reel.

8. The pipe-laying vehicle of claim 7 wherein said sweep means is spaced from the forward portion of said reel a sufficiently close distance that the pipe is directed onto the reel at a sharp incline until the pipe has approximately filled the reel.

9. The pipe-laying vehicle of claim 1 wherein said forward opening of said pickup tube is at a sufficient distance above the ground that the pipe being recovered loses contact with the ground a sufficient distance in front of the vehicle to be within the vision of the driver of the vehicle.

10. The pipe-laying vehicle of claim 1 wherein said forward opening of said pickup tube is spaced forward of a vertical plane tangent to the front wheels of the vehicle.

11. The pipe-laying vehicle of claim 1 wherein said forward opening of said pickup tube has vertical rollers adjacent the outer edges of said forward opening.

12. The pipe-laying vehicle of claim 1 wherein said forward opening of said pickup tube has a horizontal roller adjacent forward lower edge of said forward opening.

13. The process of retrieving a long string of flexible plastic pipe onto a rotating roll located on a driven vehicle comprising:

threading a free end of said pipe through a pickup zone located above said vehicle driving compartment;

attaching said free end of said reel;

rotating said reel while driving said vehicle forward towards said string of pipe to retrieve said pipe onto said reel; and mechanically guiding said pipe onto said reel while said reel is being rotated, said mechanical guide means being driven at a speed which varies in relation to the varying speed of said reel.

14. The process of claim 13 wherein said vehicle is driven at a speed to match approximately the linear velocity of said pipe passing through said pickup zone.

* * * * *